US006715383B1

(12) United States Patent
Hsien

(10) Patent No.: US 6,715,383 B1
(45) Date of Patent: Apr. 6, 2004

(54) WRENCH WITH ANGLED FUNCTION END

(76) Inventor: Chih-Ching Hsien, No. 367, Pei Yang Rd., Feng Yuan, Taichung (TW)

( * ) Notice: Subject to any disclaimer, the term of this patent is extended or adjusted under 35 U.S.C. 154(b) by 0 days.

(21) Appl. No.: 10/298,521

(22) Filed: Nov. 19, 2002

(51) Int. Cl.[7] ..... B25B 13/02
(52) U.S. Cl. ..... 81/119
(58) Field of Search ..... 81/119, 121.1, 81/418, 420, 186; 606/207

(56) References Cited

U.S. PATENT DOCUMENTS 2,886,998 A * 5/1959 Scott ..... 81/119
2,920,517 A * 1/1960 Willey, Jr. ..... 81/119
3,326,216 A * 6/1967 Wood ..... 606/207
3,446,211 A * 5/1969 Markham ..... 606/207
3,931,749 A * 1/1976 Evans ..... 81/119
4,685,360 A * 8/1987 McCurdy ..... 81/119

* cited by examiner

*Primary Examiner*—D. S. Meislin
(74) *Attorney, Agent, or Firm*—Rosenberg, Klein & Lee

(57) ABSTRACT

A wrench includes a shank and two jaws located at an end of the shank and each jaw includes a root portion which is located at a same plane as the shank, and an angled portion which extends from the root portion at an angle relative to plane on which the root portions are located. The angled portions allows the object to be tightened or loosened to be clamped by the wrench while the shank does not lie on the surface where the object is located.

3 Claims, 14 Drawing Sheets

WRENCH WITH ANGLED FUNCTION END

FIELD OF THE INVENTION

The present invention relates to a wrench having an open end which includes two jaws each include a root portion and an angled portion. The angled portions of the two jaws clamp an object while the shank is oriented an angle from the surface where the object is located.

BACKGROUND OF THE INVENTION

A conventional wrench generally includes a shank and two jaws extending from one end of the shank. The recess between the two jaws is suitable to clamp an object such as a nut or a head of a bolt which is tightened or loosened by rotating the shank. The two jaws are fixed to the shank and located in the same plain of the shank so that the tool has to be put perpendicularly to the axis of the bolt to be tightened or loosened so that the two jaws can engage the head of the bolt. Nevertheless, in some situations, the bolt to be tightened or loosened is located deep in a recess or there are other objects located beside the screw, the shank is not able to access the head of the bolt successfully.

The present invention intends to provide a wrench that has angled jaws so as to access the object at an angle.

SUMMARY OF THE INVENTION

In accordance with one aspect of the present invention, there is provided a wrench which comprises a shank with two jaws located at an end of the shank. Each jaw includes a root portion which is located at a same plane as the shank, and an angled portion which extends from the root portion at an angle relative to plane on which the root portions are located.

The primary object of the present invention is to provide a wrench wherein the jaws are angled relative to the shank so as to access a nut without being blocked by objects beside the nut.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
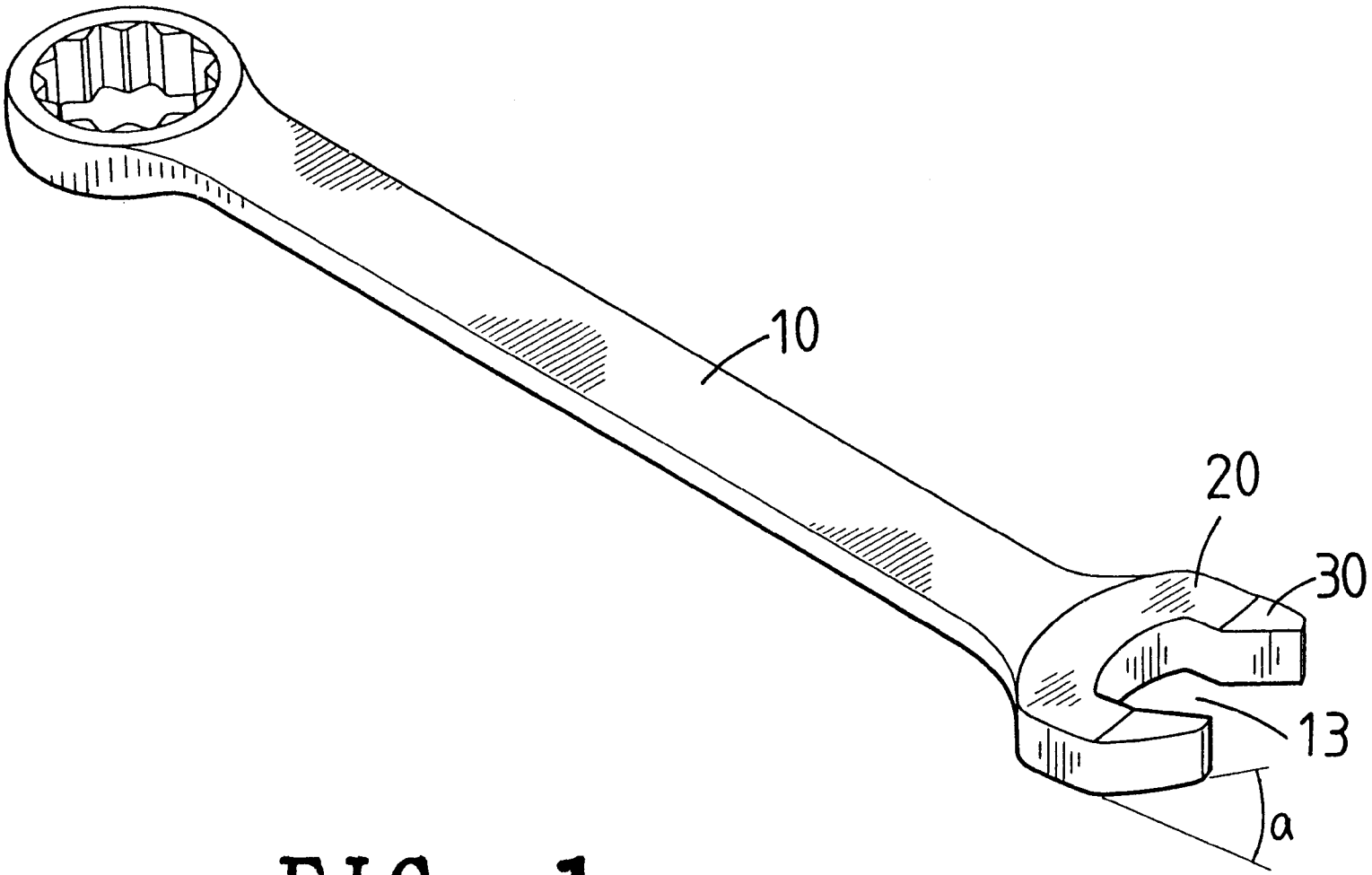
FIG. 1 is a perspective view to show the wrench of the present invention.
Figure 2:
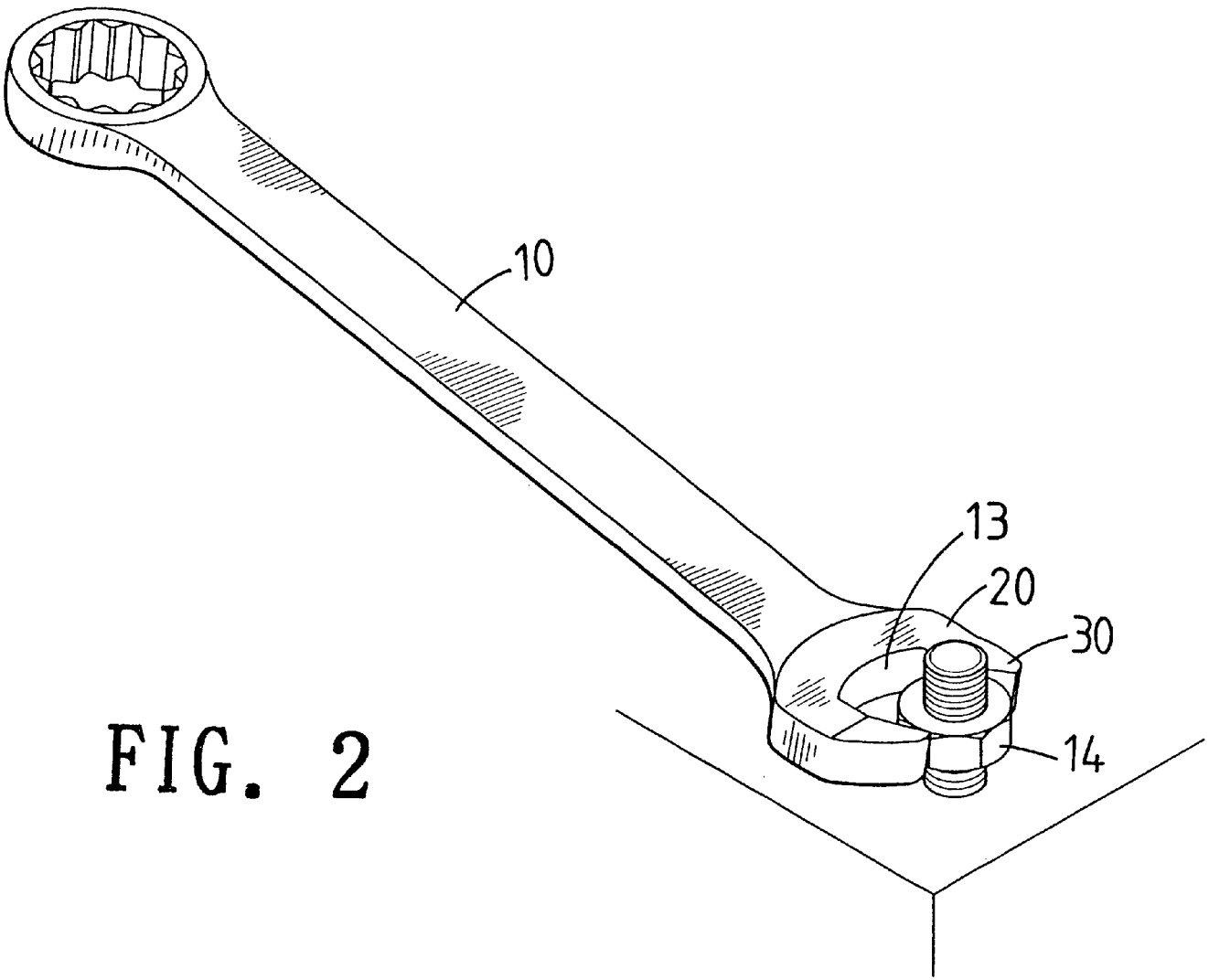
FIG. 2 shows the angled jaws clamping a nut.
Figure 3:
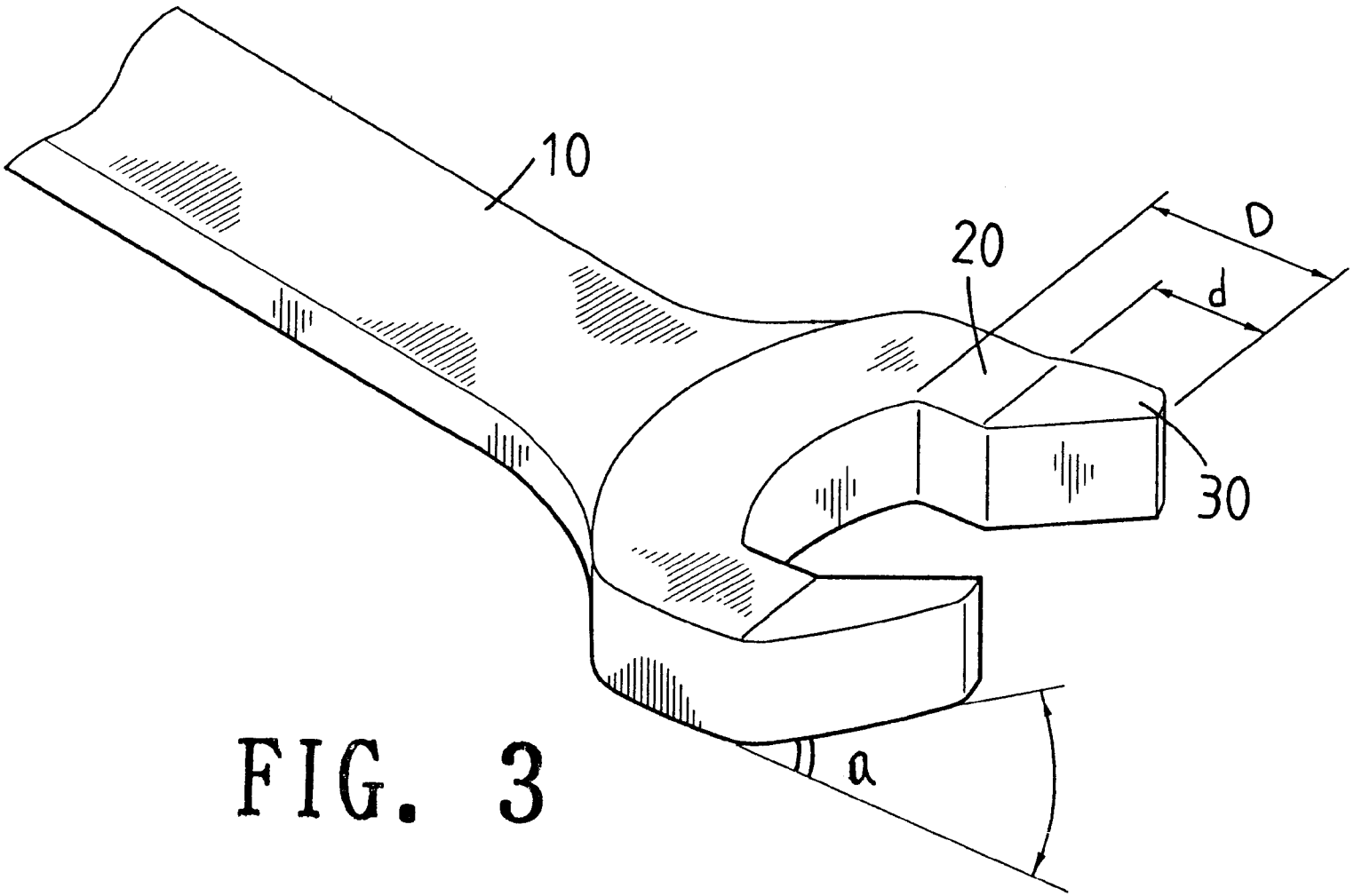
FIG. 3 is an enlarged view to show the wrench of the present invention.

Referring to FIGS. 1 and 3, the wrench of the present invention comprises a shank 1, a box end is connected to a first end of the shank 1 and two jaws extend from a second end of the shank 10. Each jaw includes a root portion 20 which is located at a same plane as the shank 10, and an angled portion 30 which extends from the root portion 20 at an angle "a" relative to a plane (not shown) on which the root portions 20 are located. An engaging recess 13 is defined between the two jaws so as to engage a polygonal object such as a nut 14 as shown in FIG. 2. The length "d" of each angled portion 30 is longer than one half (½) of a length "D" of the jaw.

Figure 4:
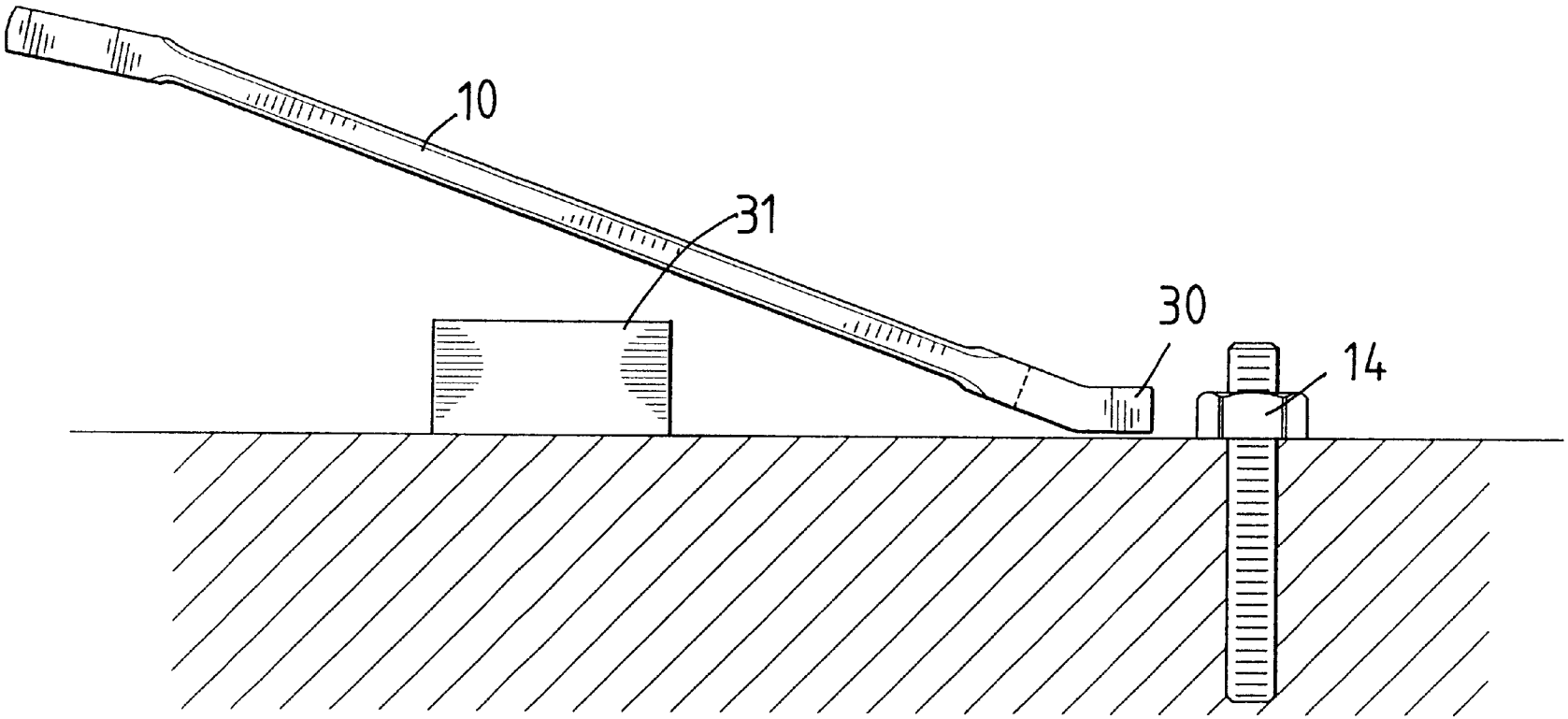
FIG. 4 shows the shank of the wrench is not blocked by the object beside the nut.
Figure 5:
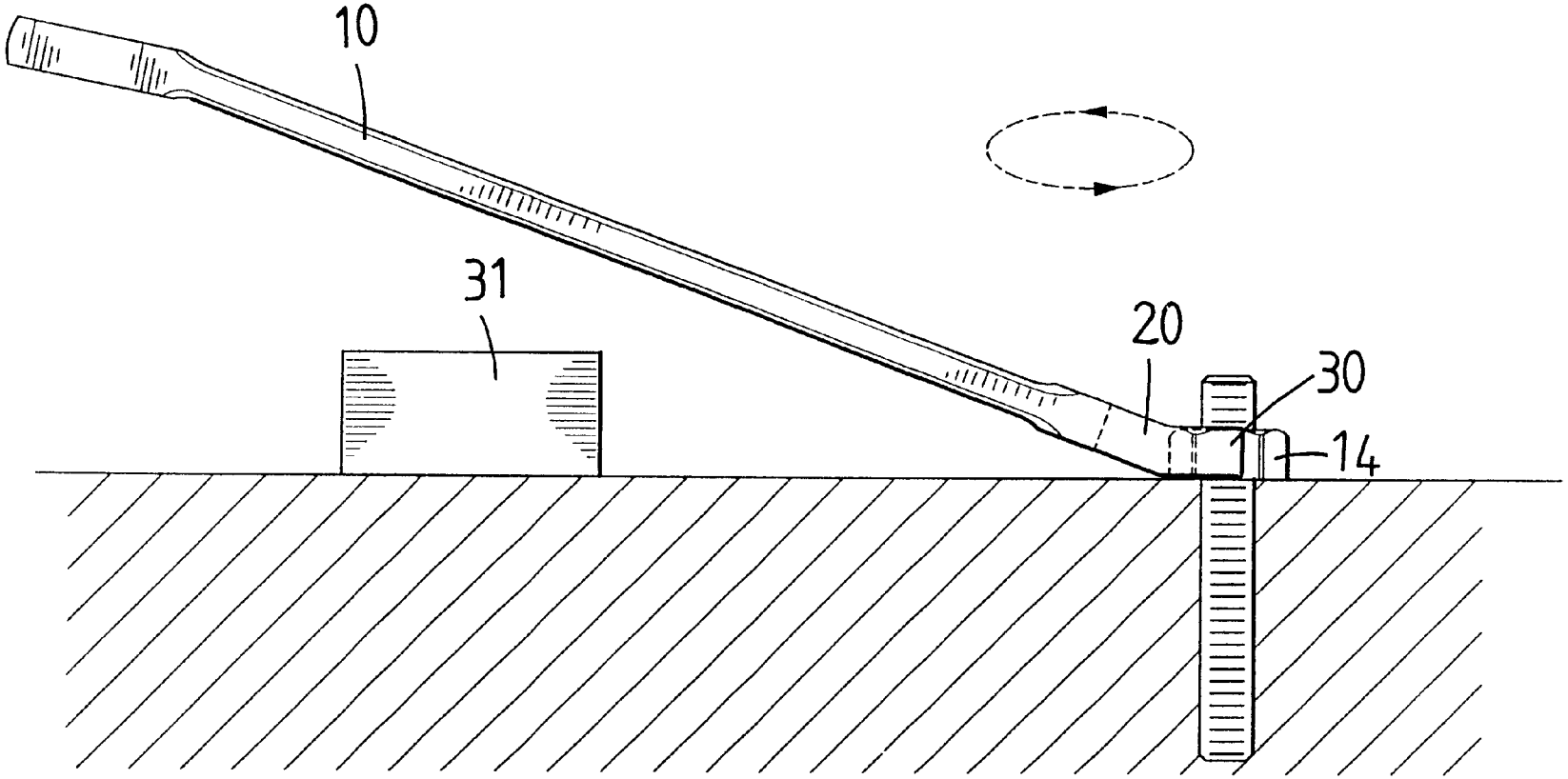
FIG. 5 shows the nut is clamped by the angled portions of the two jaws.
Figure 6:
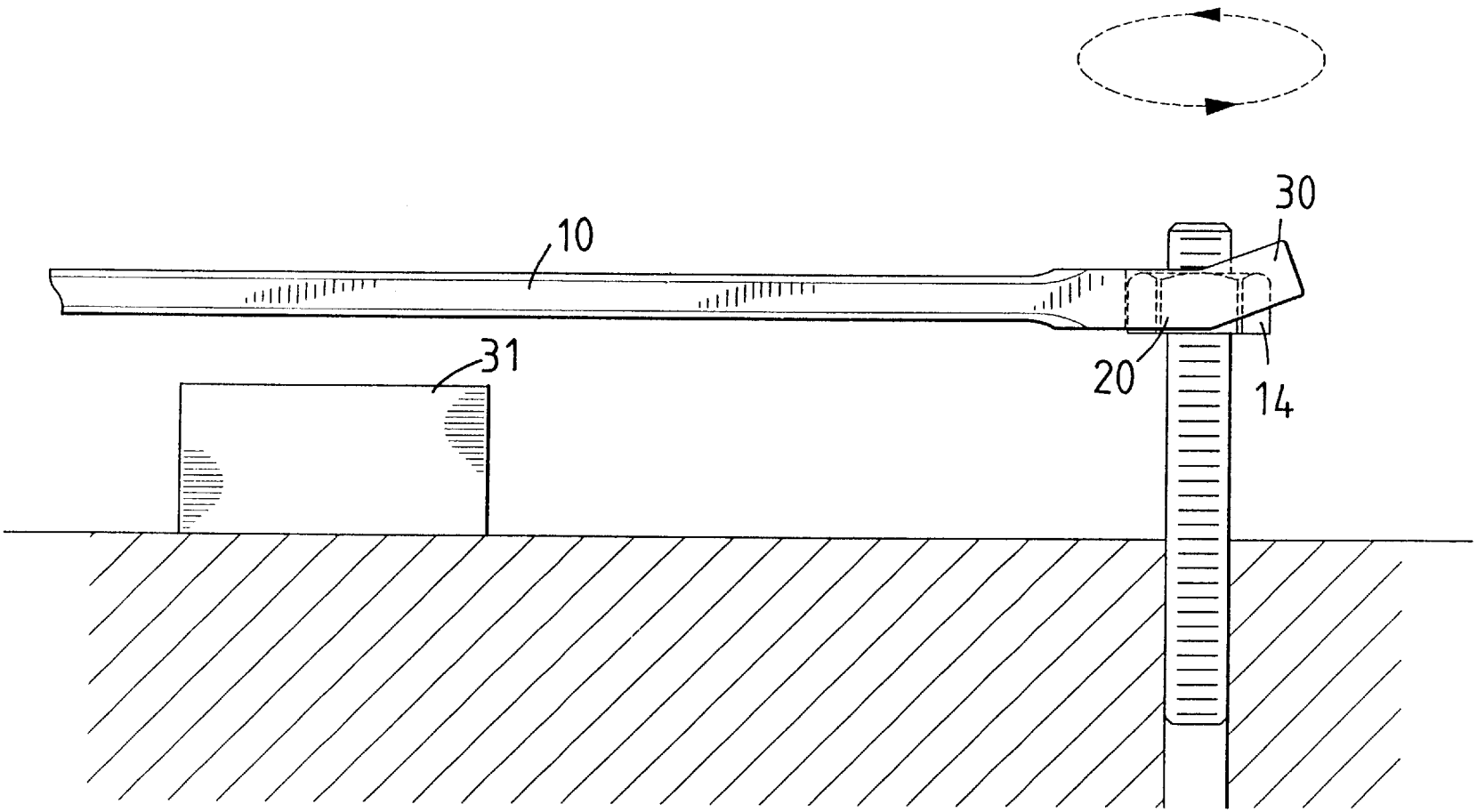
FIG. 6 shows the nut is moved upward along a threaded rod by rotating the wrench.

As shown in FIG. 4, because the angled portions 30 are located at an angle relative to the shank 10 so that the jaws are able to access the nut 14 while the shank 10 is not blocked by an object 31 located beside the nut 14. Referring to FIGS. 5 and 6, the nut 14 is first loosened by the angled portions 30 and then the nut 14 can be embraced by the root portions 20 and moved upward by rotating the shank 10.

Figure 7:
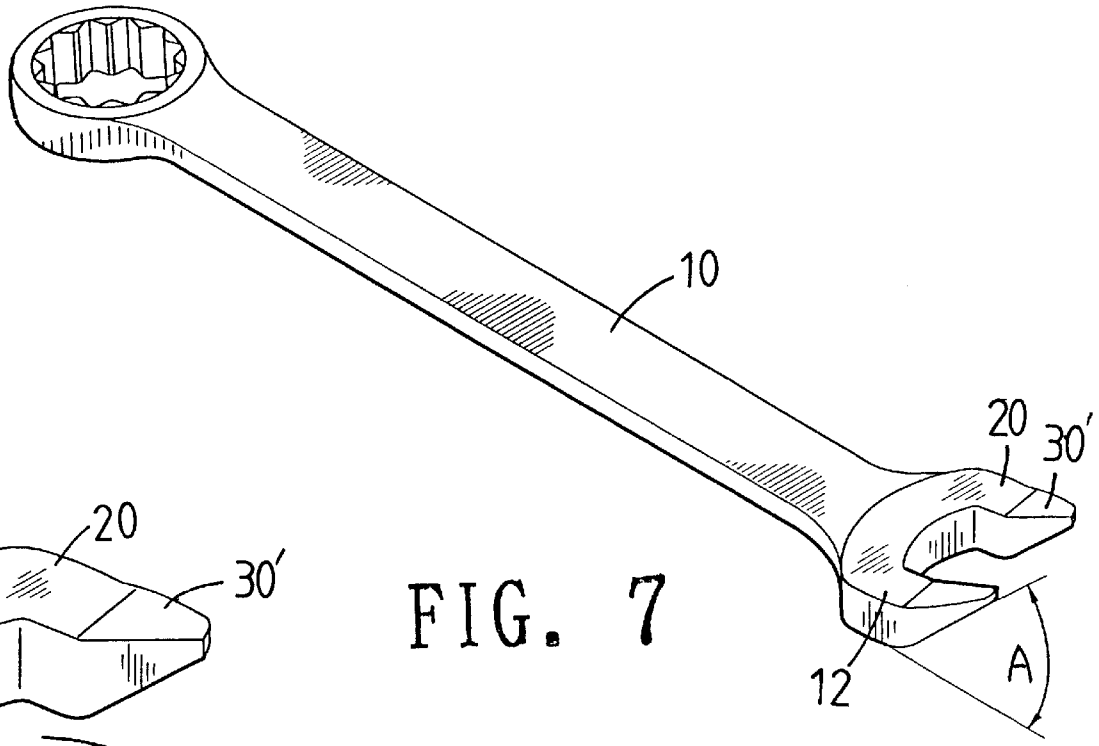
FIGS. 7 and 8 show another embodiment of the wrench of the present invention.
Figure 8:
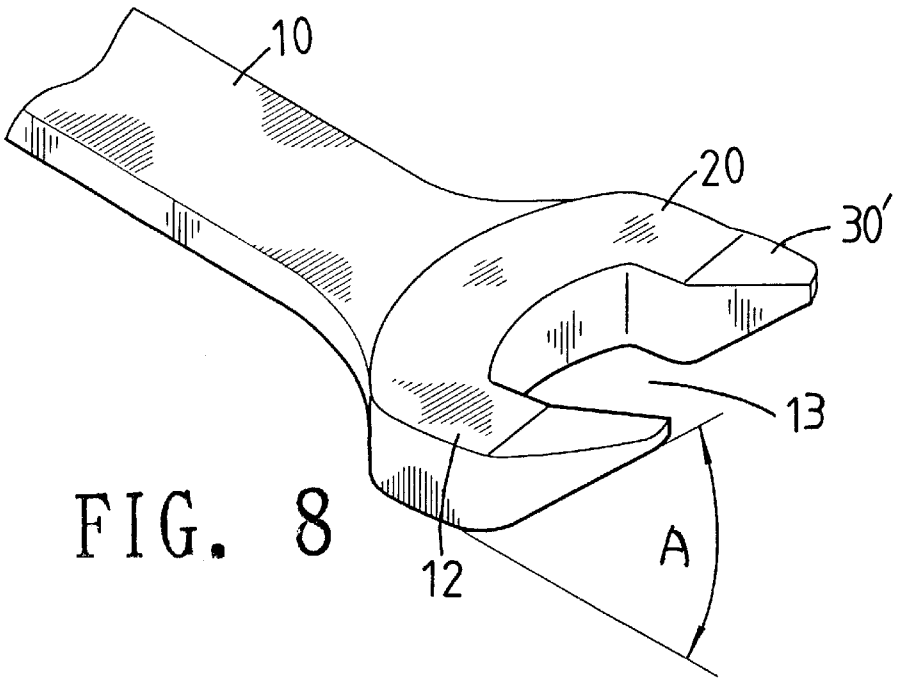
Figure 9:
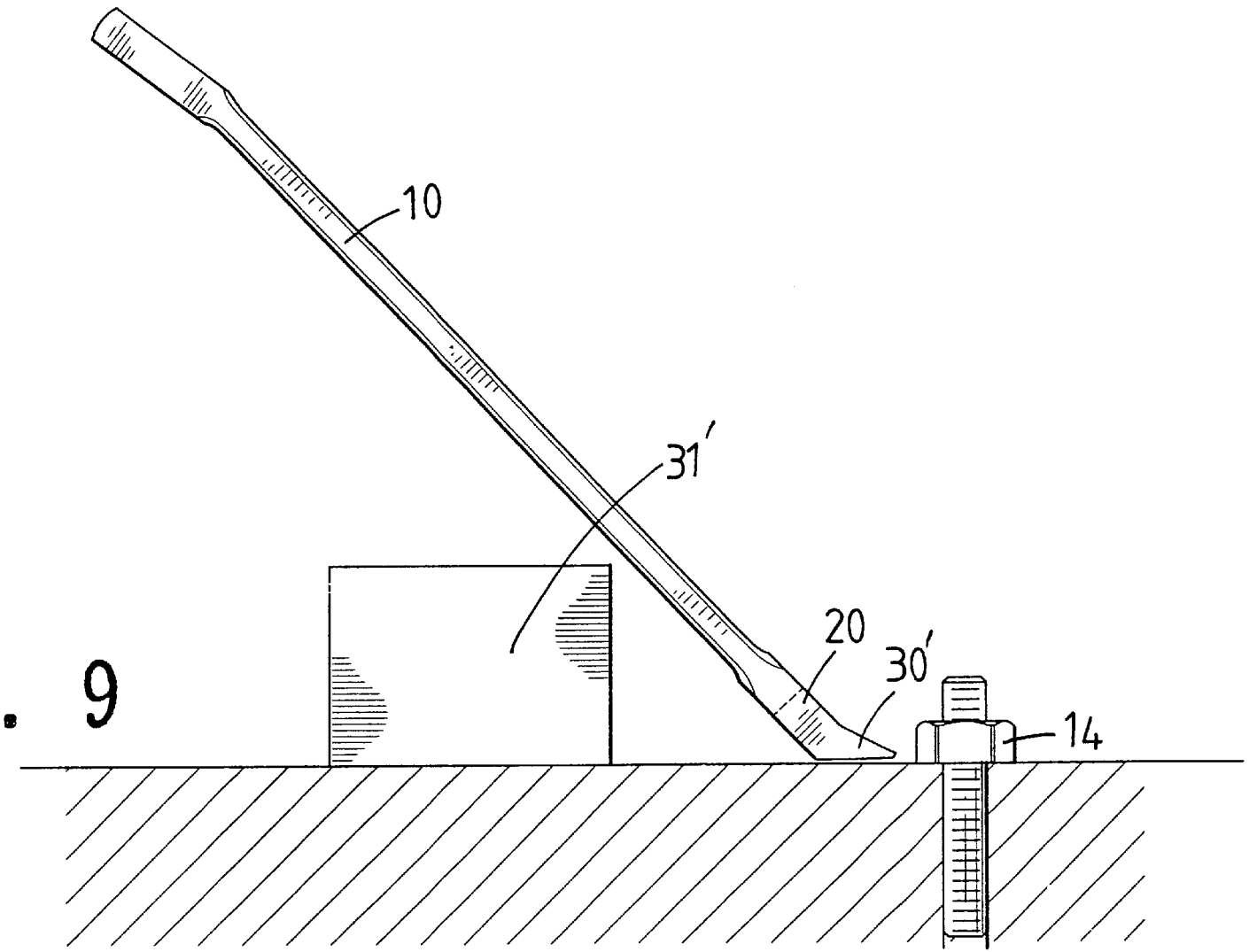
FIG. 9 shows the shank of the wrench as shown in FIG. 8 is not blocked by a higher object beside the nut.
Figure 10:
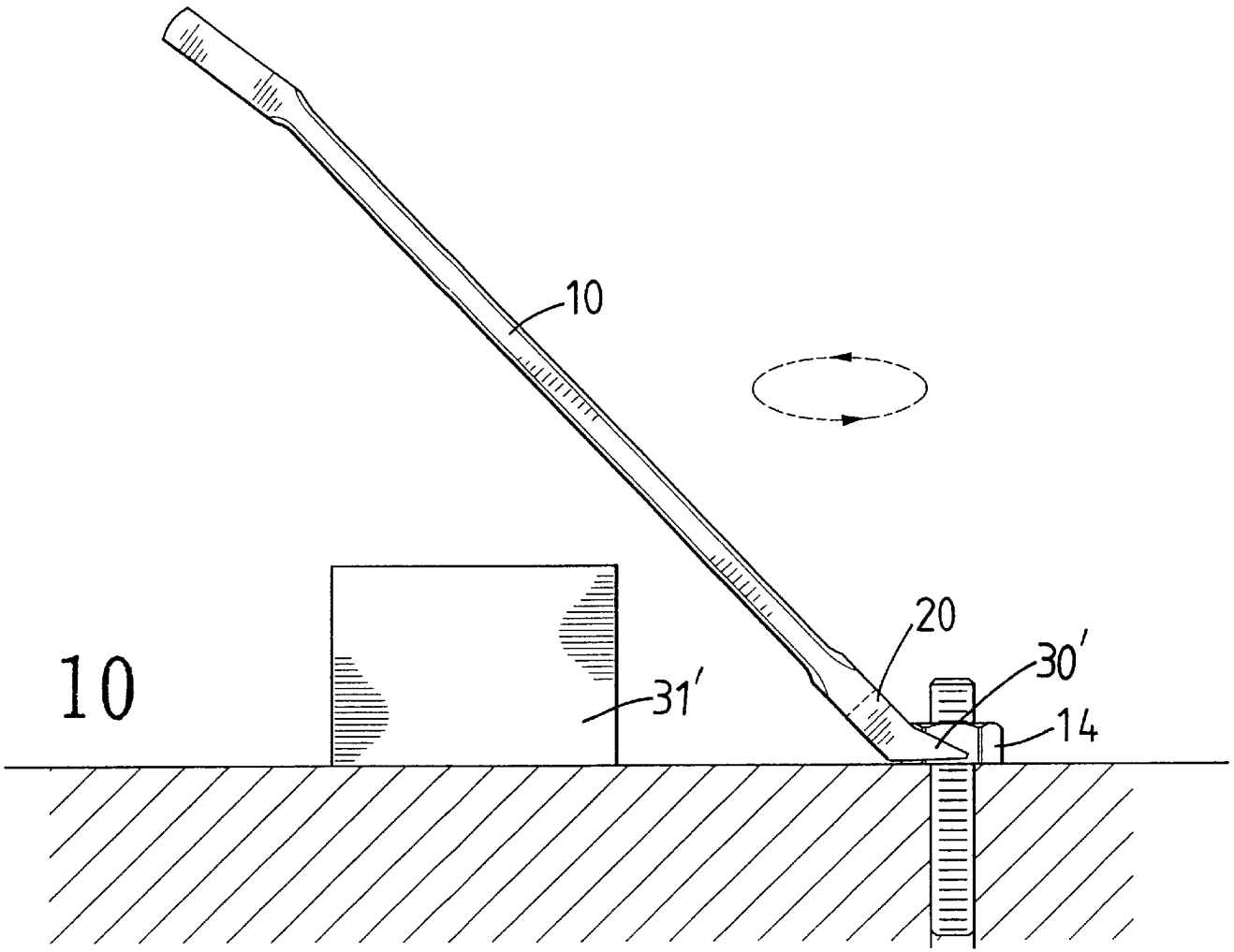
FIG. 10 shows the nut is clamped by the root portions of the two jaws as shown in FIG. 8.
Figure 11:
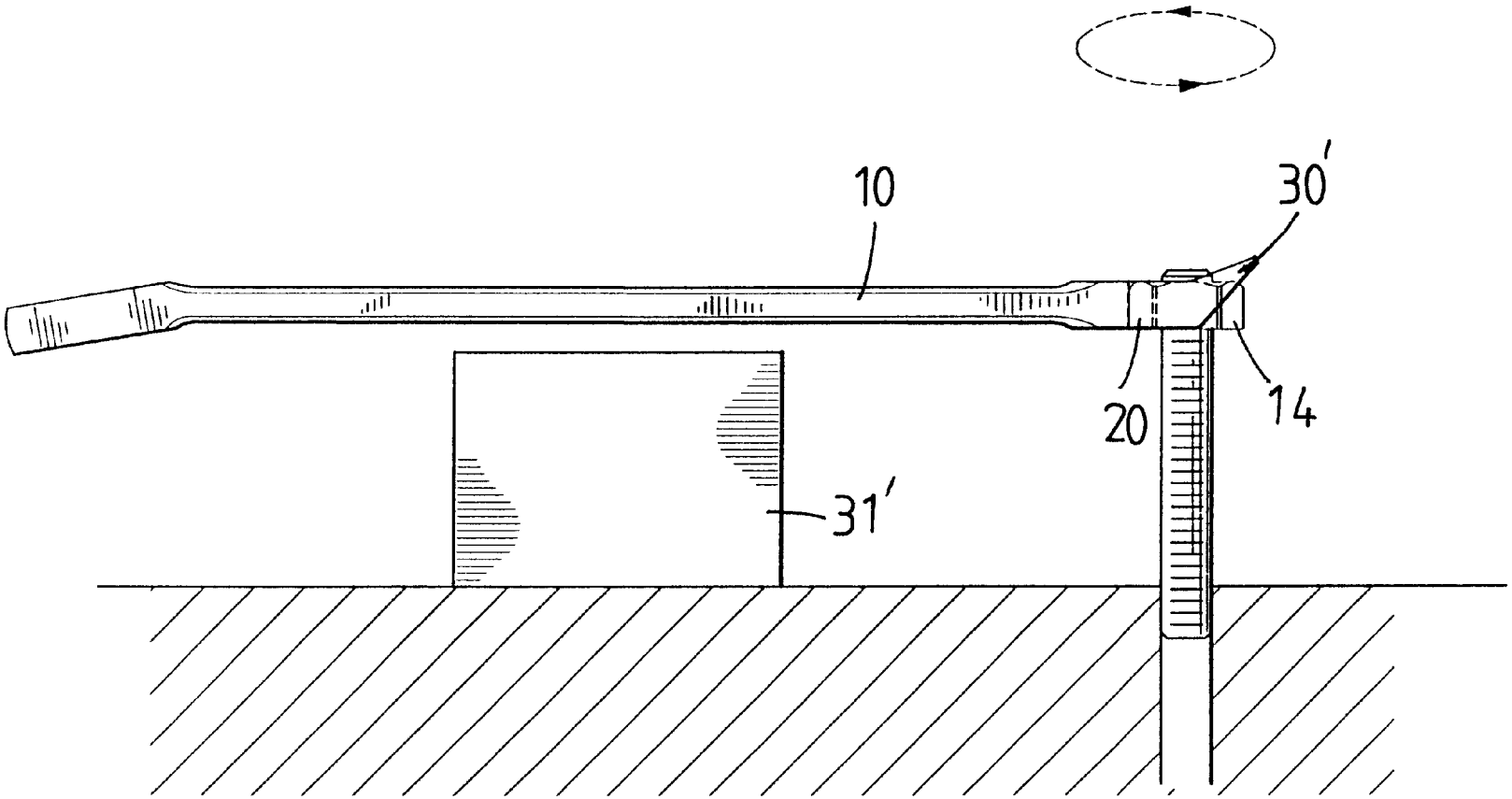
FIG. 11 shows the nut is moved upward along a threaded rod by rotating the wrench as shown in FIG. 8.

FIGS. 7 and 8 show that each of the two angled portions 30' can be made to be a wedge-shaped portion which has a large angle "A" defined between an underside of the angled portions 30' and the plane that the shank 10 is located. As shown in FIGS. 9 to 11, a large angle is allowed for the access of the angled portions 30' to the nut 14 while the shank 10 is not blocked by a high object 31'.

Figure 12:
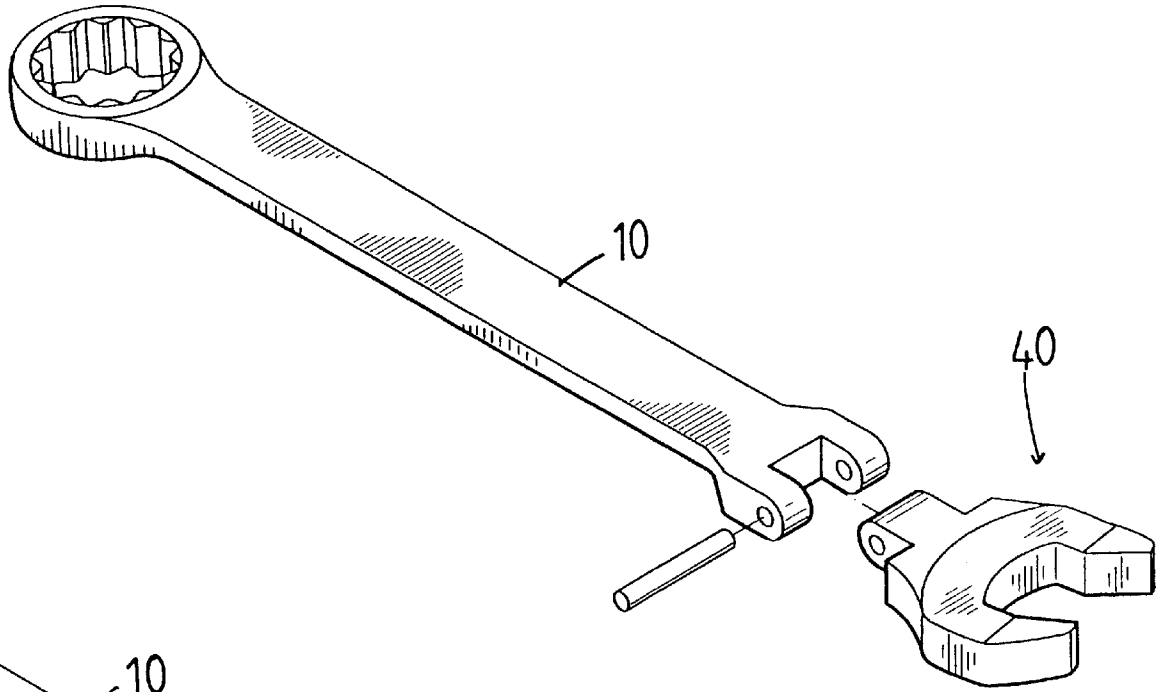
FIG. 12 shows the wrench has a pivotable member which has the two jaws.
Figure 13:
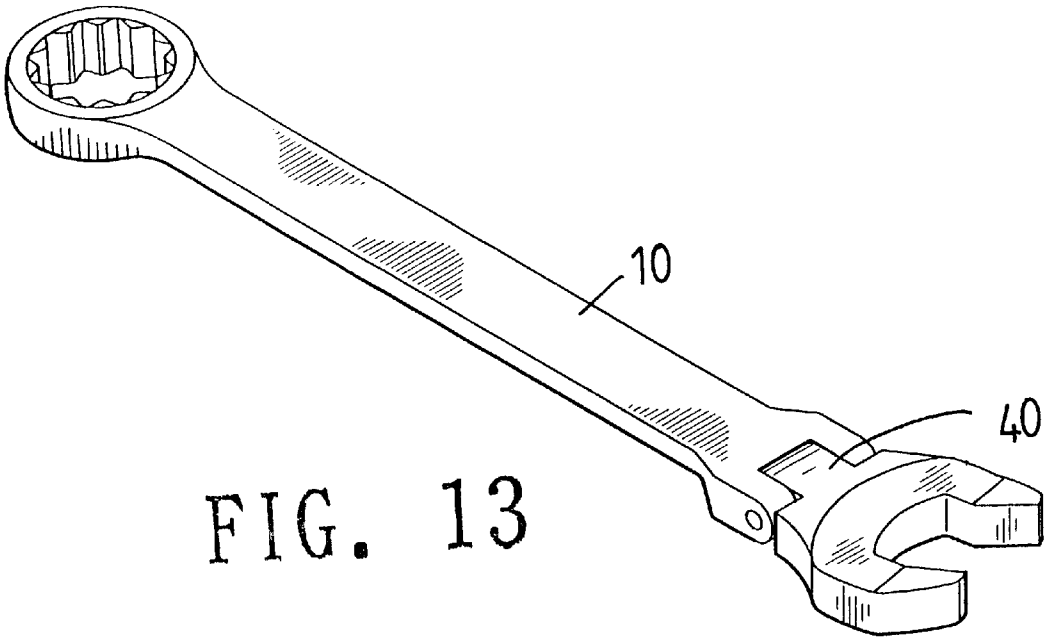
FIG. 13 show a perspective view of the wrench as shown in FIG. 12.
Figure 14:
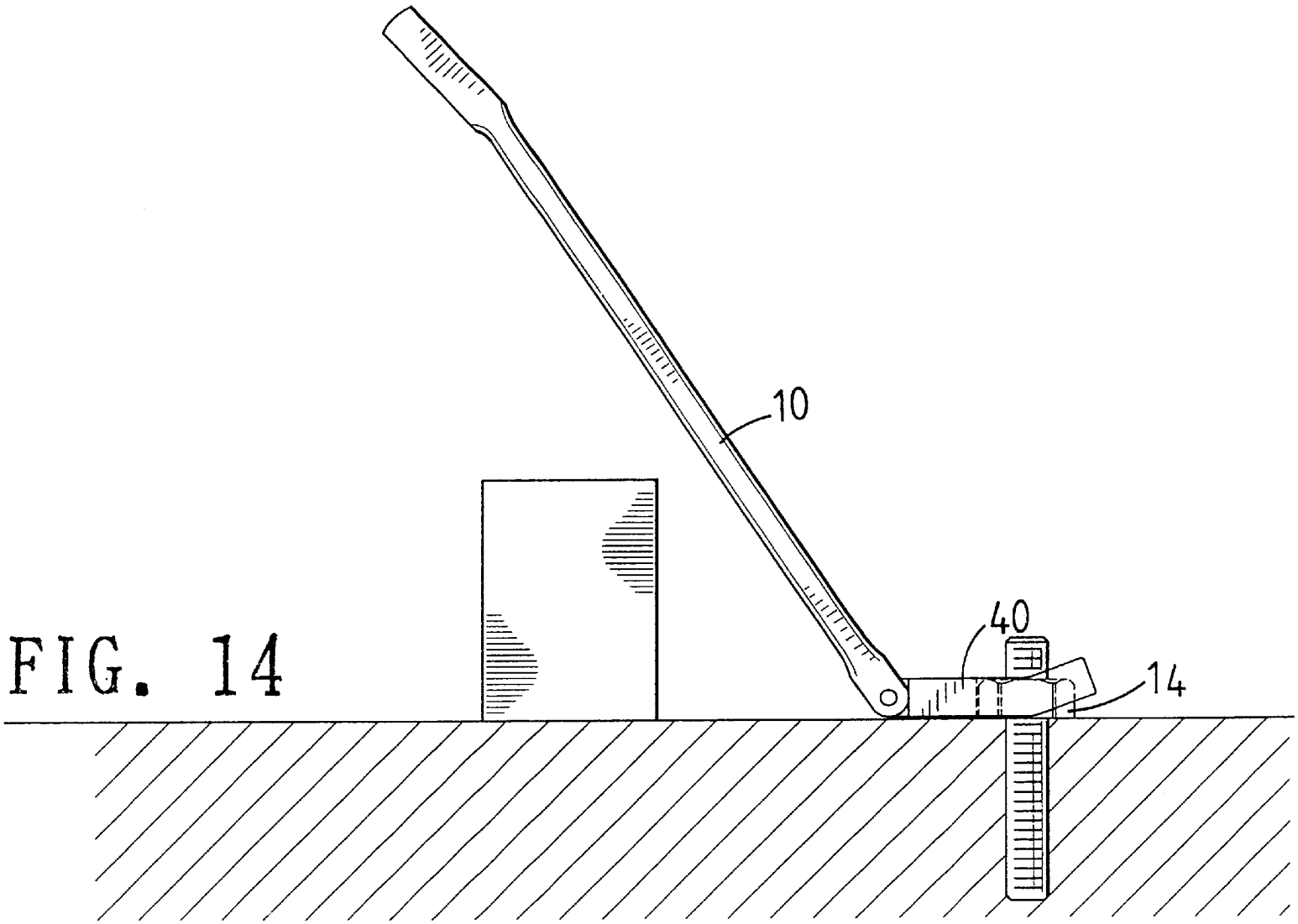
FIG. 14 shows the pivotable member is pivoted and clamps a nut.

Referring to FIGS. 12 to 14, the two jaws can also be a one-piece member with a pivotable member 40 which is pivotably connected to the second end of the shank 10. The two jaws extending from the pivotable member 40 which is able to be pivoted at a desired angle to access the nut 14.

Figure 15:
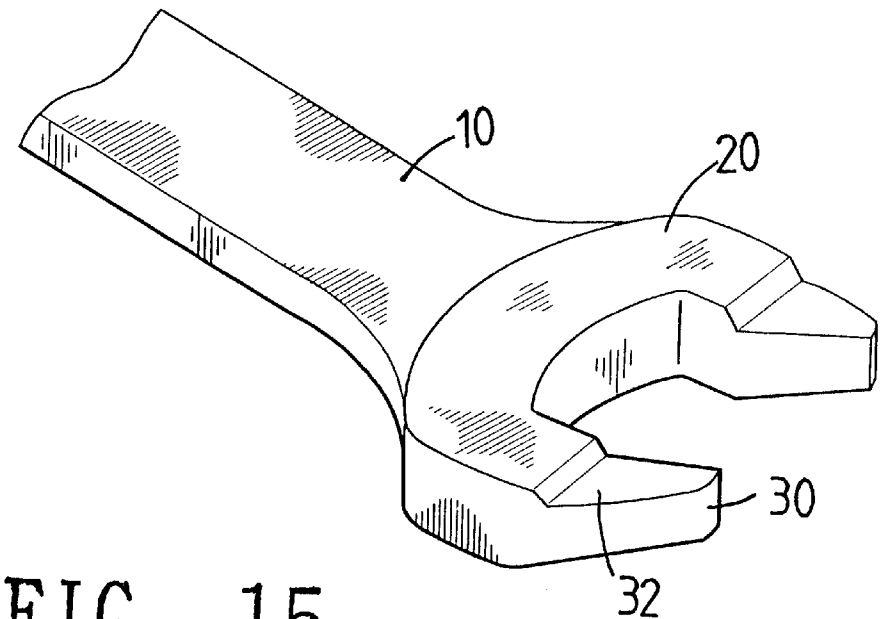
FIG. 15 shows a recess is defined in each of the angled portion of the wrench of the present invention.
Figure 16:
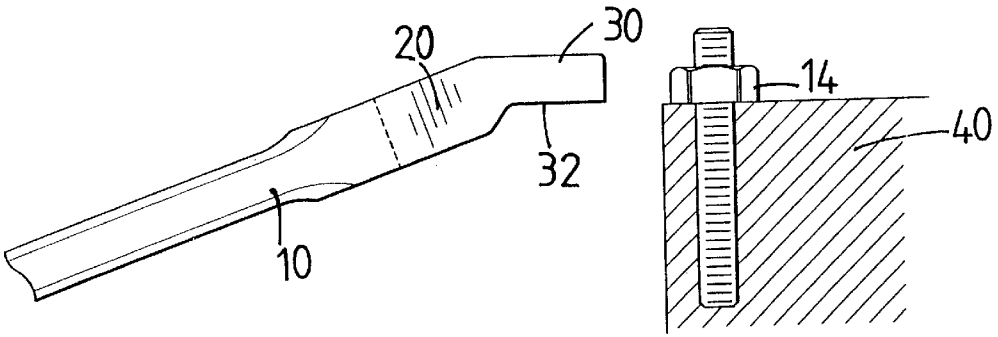
FIG. 16 shows the recess of the angled portion allows the wrench to approach a nut located at an edge of an object.
Figure 17:
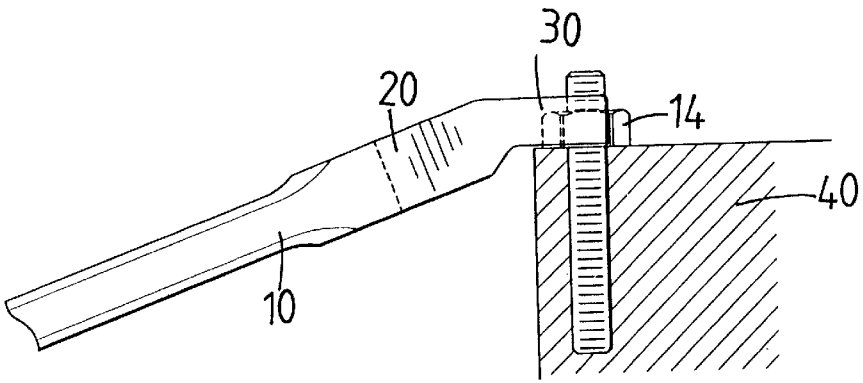
FIG. 17 shows the wrench is engaged with the nut at the edge of the object.

Referring to FIGS. 15 to 17, each of the angled portions 30 has a recess 32 defined in a side thereof so that the wrench is conveniently approach a nut 14 located at an edge of an object 40 such as a desk top. The recesses 32 allow the corner of the object 40 to be accommodated in therein such that the two angled portions 30 are able to clamp the nut 14.

While we have shown and described the embodiment in accordance with the present invention, it should be clear to those skilled in the art that further embodiments may be made without departing from the scope of the present invention.

What is claimed is:

1. A wrench comprising:

a shank and two jaws fixedly located at an end of the shank, an engaging recess defined between the two jaws and a size of the engaging recess being fixed, each jaw including a root portion which is located at a same plane as the shank, and an angled portion which extends from the root portion at an angle relative to the shank and the root portions, each of the two angled portions being a wedge-shaped portion and having a recess defined in a side thereof.

2. The wrench as claimed in claim 1, wherein a length of each angled portion is longer than one half of a length of the jaws.

3. A wrench comprising:

a shank, and a pivotable member pivotably connected to an end of the shank and two jaws extending from the pivotable member, an engaging recess defined between the two jaws and a size of the engaging recess being fixed, each jaw including a root portion which is located at a same plane as the shank, and an angled portion which extends from the root portion at an angle relative to the shank and the root portions, each of the two angled portions being a wedge-shaped portion and having a recess defined in a side thereof.

* * * * *